United States Patent [19]

Sasao et al.

[11] 4,306,130

[45] Dec. 15, 1981

[54] ARC SELF-EXTINGUISHING SWITCH DEVICE

[75] Inventors: Hiroyuki Sasao; Yoshihiro Ueda; Hajimu Yoshiyasu; Soichiro Okuda, all of Amagasaki, Japan

[73] Assignee: Mitsubishi Denki Kabushiki Kaisha, Tokyo, Japan

[21] Appl. No.: 21,250

[22] Filed: Mar. 16, 1979

[30] Foreign Application Priority Data

| | | | |
|---|---|---|---|
| Mar. 18, 1978 | [JP] | Japan | 53-31459 |
| Mar. 18, 1978 | [JP] | Japan | 53-31460 |
| Apr. 19, 1978 | [JP] | Japan | 53-47024 |
| Aug. 16, 1978 | [JP] | Japan | 53-100227 |

[51] Int. Cl.[3] ..... H01H 33/82

[52] U.S. Cl. ..... 200/148 R

[58] Field of Search ..... 200/150 R, 150 A, 150 B, 200/150 J, 149, 148 R, 148 A, 148 B, 148 C, 148 E, 148 G

[56] References Cited

U.S. PATENT DOCUMENTS

| | | | |
|---|---|---|---|
| 2,988,622 | 6/1961 | Petermichl et al. | 200/148 C X |
| 3,128,360 | 4/1964 | Rietz | 200/149 A X |
| 3,143,624 | 8/1964 | Hofmann | 200/150 B |
| 4,048,456 | 9/1977 | Noeske | 200/148 A |
| 4,206,331 | 6/1980 | Kii | 200/148 R |
| 4,218,597 | 8/1980 | Kii | 200/148 R |
| 4,239,949 | 12/1980 | Kii et al. | 200/148 R |
| 4,242,550 | 12/1980 | Kii | 200/148 R |

FOREIGN PATENT DOCUMENTS 671842 9/1929 France .

*Primary Examiner*—James R. Scott

*Attorney, Agent, or Firm*—Wenderoth, Lind & Ponack

[57] ABSTRACT

A switch comprises an envelope including a pressure increasing compartment filled with an arc extinguishing fluid. A slit extends through one longitudinal side of the envelope to communicate with the compartment. A movable contact member having a flat cross section normally extends through the slit to block substantially the slit until the movable member engages a stationary contact member outside of the slit. The arc extinguishing fluid increases in pressure in response to heat of an electric arc established across the separated contact member and delivered through the slit to be perpendicular to the arc axis.

13 Claims, 16 Drawing Figures

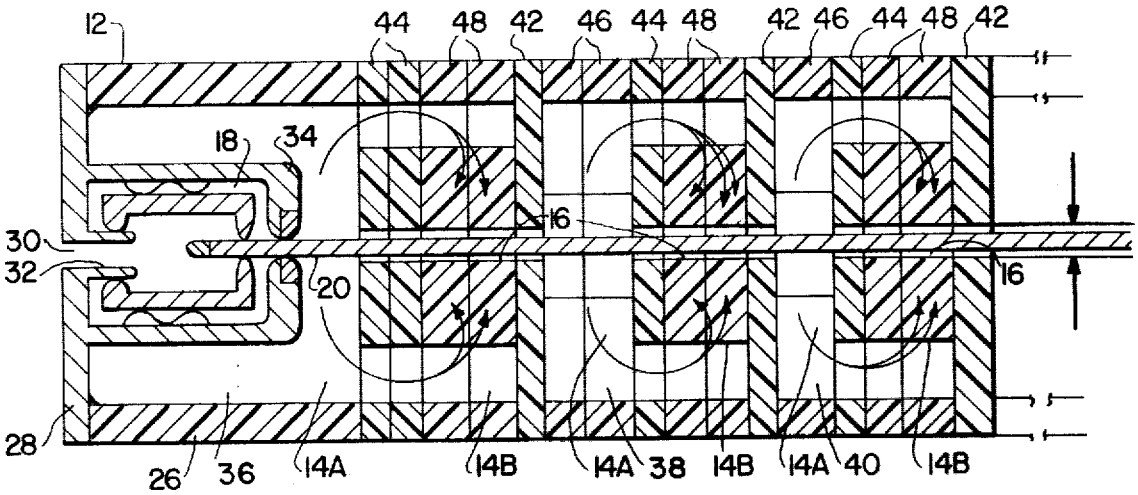
FIG. 12
FIG. 13
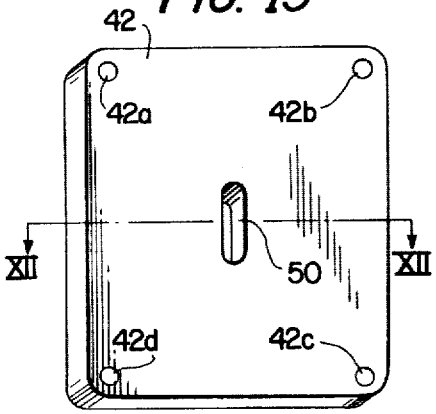
FIG. 14
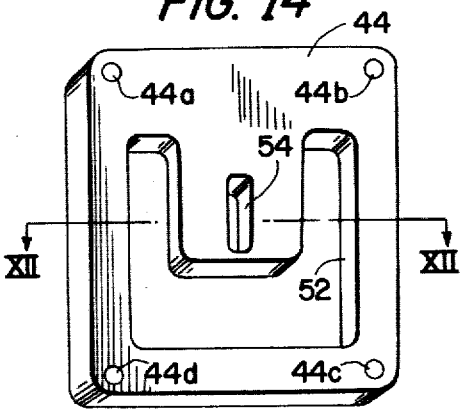
FIG. 15
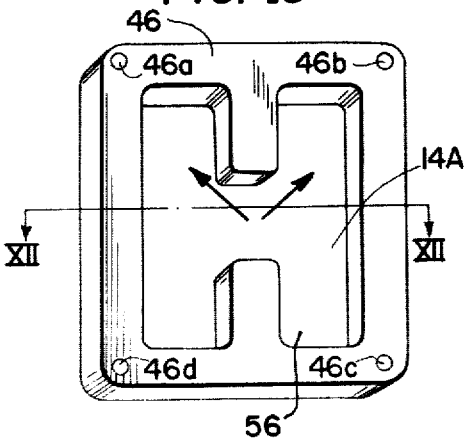
FIG. 16
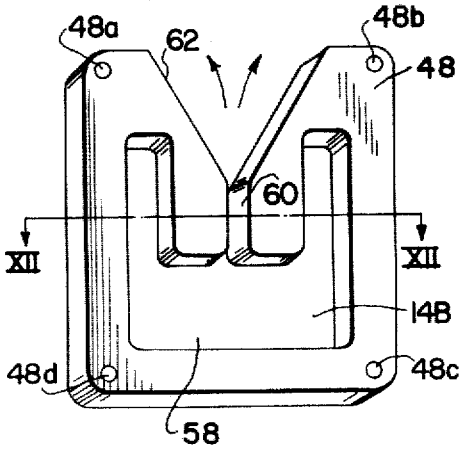

ARC SELF-EXTINGUISHING SWITCH DEVICE

BACKGROUND OF THE INVENTION

This invention relates to a switch device for self-extinguishing an electric arc struck across a pair of contact members by utilizing a gas expanded due to heat of the electric arc.

There have been recently developed simply, highly economical switch devices of the type including an amount of an arc extinguishing fluid such as gaseous sulfur hexafluoride ($SF_6$) filling an arc extinguishing compartment space having a suitable volume and operative to put the arc extinguishing fluid under a high pressure through the utilization of the pressure increasing action resulting from thermal energy mainly provided by an electric arc itself and to extinguish the electric arc by delivering the fluid forming a high pressure source to an arc space in the process of decreasing the resulting arc current to a null magnitude.

However, it is well known that in arc self-extinguishing switch devices of conventional construction, the heat action of electric arcs for increasing the pressure becomes excessively large with an increase in arc current and the arc extinguishing fluid within the arc extinguishing compartment is put at elevated temperatures with the result that the arc extinguishing ability reduces with an increase in arc current. Also, such switch devices have been disadvantageous in that the rate of release of the high pressure source can not be readily controlled because the release of the high pressure source is accomplished by the movable contact member whose size is determined by a current normally flowing therethrough.

When arc self-extinguishing switch devices of the above type include a pressure increasing compartment having a volume and a pressure releasing opening formed to be fitted for the interruption of high short circuiting currents, the resulting pressure increasing action is small with relatively low currents such as currents somewhat higher than the load current because thermal energy of the electric arc struck upon the separation of contact members generally is low. In order to attain sufficiently the pressure increasing action at low currents, it is necessary to make the volume of the pressure increasing compartment small and the pressure releasing opening also small. However, if this is done, the pressure increasing compartment having a small volume suitable for interrupting low currents has been disadvantageous in that the temperatures within the pressure increasing and arc extinguishing compartments rises higher than is necessary. This has permitted the arc extinguishing fluid to be rather ionized thereby to promote the growth of the electric arc resulting in the arc extinguishing function being disabled.

Accordingly it is a general object of the present invention to eliminate the disadvantages of the prior art practice as above described.

It is an object of the present invention to provide a new and improved arc self-extinguishing switch device capable of controlling independently a current capacity and an interrupting performance.

SUMMARY OF THE INVENTION

The present invention provides an arc self-extinguishing switch device comprising, in combination, a housing filled with an amount of an arc extinguishing fluid, an envelope disposed within the housing and including at least one pressure increasing compartment filled with an amount of the arc extinguishing fluid, a pair of contact members disposed within the envelope to engage and disengage from each other, and an opening disposed on one side of the envelope to discharge the arc extinguishing fluid within the pressure increasing compartment to the housing in a direction substantially perpendicular to the axis of an electric arc established across the pair of contact members separated from each other, at least one of the contact members having a flat cross section and being disposed in the opening so as to permit opening and closing the opening.

In order to control the behavior of the electric arc, the envelope may comprise a plurality of arc splitters for dividing the opening axially of the electric arc into a plurality of opening portions.

Advantageously, the envelope may include a plurality of pressure increasing compartments disposed in tandem manner lengthwise thereof, and each pair of adjacent pressure increasing compartments include the respective openings directed in different directions preferably in the diametrically opposite direction, whereby the electric arc is permitted to tend to be moved away from the blowing arc extinguishing fluid only in the vicinity of the openings.

In order to effect always the stabilized extinction of electric arcs regardless of magnitudes of current to be interrupted, the plurality of pressure increasing compartments may have different volumes.

BRIEF DESCRIPTION OF THE DRAWINGS

The present invention will become more readily apparent from the following detailed description taken in conjunction with the accompanying drawings in which:

FIG. 12 is a fragmental longitudinal sectional view of still another modification of the present invention with the section taken along the line XII—XII of each of FIGS. 13, 14, 15 and 16 and viewed in the direction of the arrow shown therein; and FIGS. 13, 14, 15 and 16 are perspective views of four different envelope forming members used to form pressure increasing compartments shown in FIG. 12.

Throughout the Figures like reference numerals designate identical or corresponding components.

DESCRIPTION OF THE PREFERRED EMBODIMENTS

Figure 1:
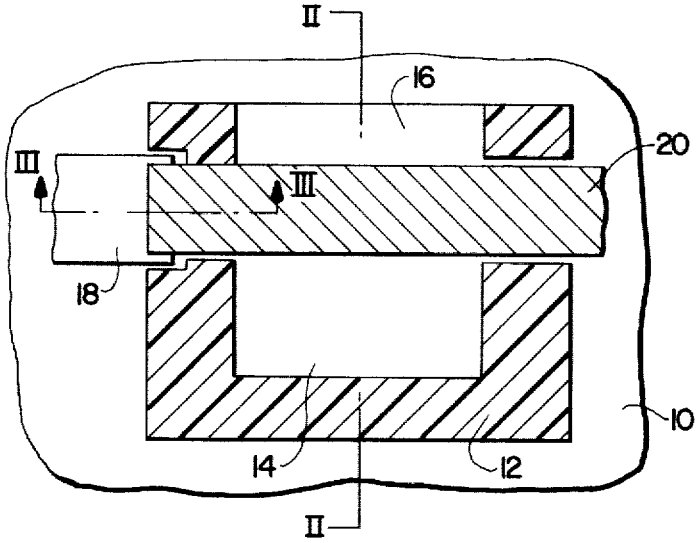
FIG. 1 is a schematic longitudinal sectional view of the essential portion of one embodiment according to the arc self-extinguishing switch device of the present invention.
Figure 2:
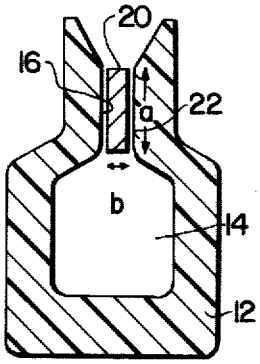
FIG. 2 is a cross sectional view as taken along the line II—II of FIG. 1.

Referring now to FIG. 1 of the drawings, there is illustrated one embodiment according to the arc self-extinguishing switch device of the present invention. The arrangement illustrated comprises a housing 10 filled with an amount of an arc extinguishing fluid such as gaseous sulfur hexafluoride ($SF_6$) or the like and an envelope 12 disposed within the housing 10. The envelope is formed of any suitable arc resisting, electrically insulating material such as polytetrafluoroethylene into such a shape that, as best shown in FIG. 2, a lower swelled portion thereof defines a pressure increasing compartment 14 with a suitable volume and is connected through a transitional portion to a neck portion which defines an opening 16 in the form of a straight slit having a predetermined depth and a predetermined width. The opening 16 includes one end communicating with the pressure increasing compartment 14 and the other end flared and opening in the housing 10. Thus the opening 16 is disposed on one side of the envelope 12.

The pressure increasing compartment 14 is filled with an amount of the same arc extinguishing fluid as that filling the housing 10 and provides a source of high pressure fluid in operation. That is, the arc extinguishing fluid within the pressure increasing compartment 14 is arranged to be delivered to the interior of the housing 10 substantially perpendicularly to the axis of an electric arc established across a pair of contact members which will subsequently be described. To this end, the opening 16 opens in the housing 10 on that side of the resulting arc space remote from the pressure increasing compartment 14. Thus the opening 16 forms an arc extinguishing compartment with the pressure increasing compartment 14.

Figure 3:
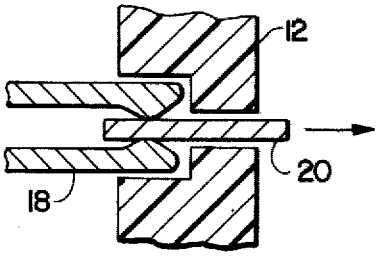
FIG. 3 is a schematic sectional view as taken along the line III—III of FIG. 1.

A stationary contact member 18 shown in FIG. 3 as including a pair of opposite club-shaped arms is fixedly secured on one end portion to one end wall of the envelope 12 by any suitable means (not shown) so that the opposite free ends of both arms are located in a recess disposed on the one end wall of the envelope 12 as best shown in FIG. 3. The stationary contact member 18 is connected at the other end to an electrode terminal (not shown). Then a movable contact member 20 is slidably extended through the opening 16 and includes one end separably sandwiched between the opposite free ends of the stationary contact member 18 as shown in FIG. 3 and the other end connected to an operating mechanism such as trip means. As best shown in FIG. 2, the movable contact member 20 has a rectangular cross section having a width a and a thickness b so that, during its engagement with the stationary contact member 18 the movable contact member 20 extends through and closes the opening 16 while it forms a narrow clearance 22 with each of the opposite surfaces of the opening 16 as shown in FIG. 2. It is to be understood that the movable contact member 20 is not restricted to the rectangular cross section and that it may be of any desired flat cross section, for example, in the form of an ellipse or a prolate circle or the like.

In operation the trip means (not shown) is initiated to perform the tripping operation in response to a command tripping signal so that the movable contact member 20 starts to be moved in the righthand direction as viewed in FIG. 1. When the movable contact member 20 moves a suitable wiping distance relative to the stationary contact member 18 to disengage from the latter, an electric arc is struck across the separated contact members 18 and 20. This electric arc is established in the narrow clearances 22 located between the movable contact member 20 and the adjacent surfaces of the opening 16. Therefore, the electric arc blocks the arc extinguishing fluid within the pressure increasing compartment 14 to permit a pressure within the compartment 14 to rise rapidly due to heat provided by the electric arc.

If the resulting arc current is high then the heat provided by the electric arc partly escapes into the housing 10 from that side of the movable contact member 20 facing the flared outlet of the opening 16 thereby to prevent the interior of the pressure increasing compartment 14 from rising to an elevated temperature.

As soon as the movable contact member 20 is further moved in the righthand direction as viewed in FIG. 1 to begin the process of decreasing the arc current, the electric arc diminishes in dimension until the pressure increasing compartment 14 is no longer blocked. This causes the arc extinguishing fluid put at a low temperature under a high pressure within the pressure increasing compartment 14 to be delivered to the interior of the housing 10 through the opening 16.

Under these circumstances, the delivered high pressure fluid flows and diffuses to cross the electric arc perpendicularly to the axis thereof and passes through the slit-shaped opening 16. Therefore the low temperature, high pressure fluid is effectively blown against the arc space to cool the electric arc, thus resulting in the rapid extinction of the latter.

Figure 5:
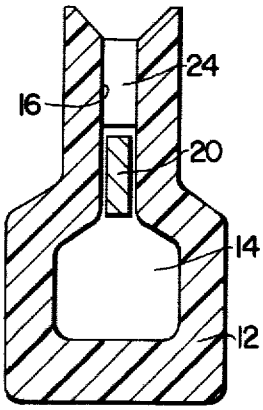
FIG. 5 is a cross sectional view as taken along the line V—V of FIG. 4.
Figure 4:
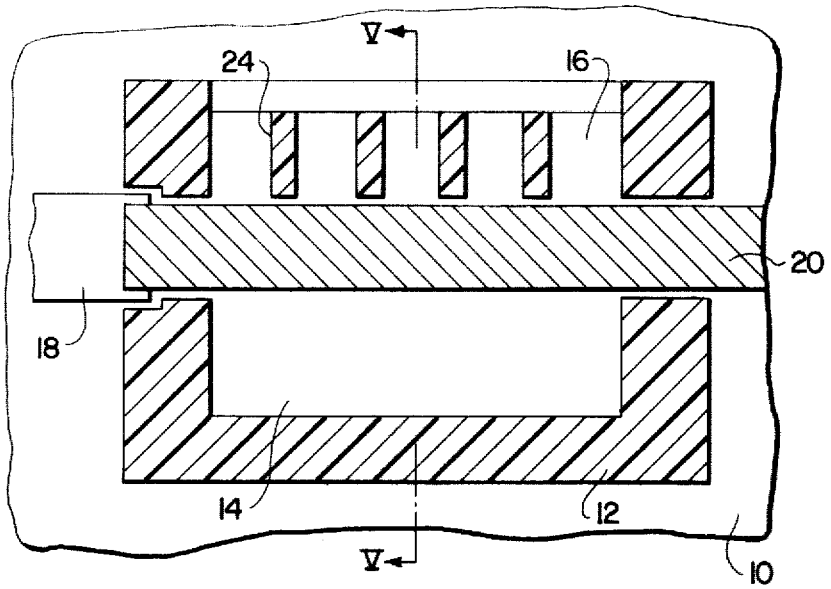
FIG. 4 is a view similar to FIG. 1 but illustrating a modification of the present invention.

The arrangement illustrated in FIGS. 4 and 5 is different from that shown in FIGS. 1, 2 and 3 only in that in FIGS. 4 and 5, the opening 16 is made long enough in the transverse direction of the movable contact member 20 to permit a plurality of arc splitters 24 to be disposed at substantially equal intervals lengthwise of the movable contact member 20 and in an outlet portion of the opening 16 with the movable contact member 20 located in that portion of the opening 16 adjacent to the pressure increasing compartment 14. The arc splitters are formed of a material excellent in arc extinguishing performance, for example zircon, and serve to divide the outlet of the opening 16. Therefore the arc extinguishing fluid is put under a high pressure within the pressure increasing compartment 14 and is blown against the electric arc through a plurality of divided outlet portions of the opening 16, thereby to control the behavior of the electric arc, that is a range in which the electric arc is movable.

Figure 6:
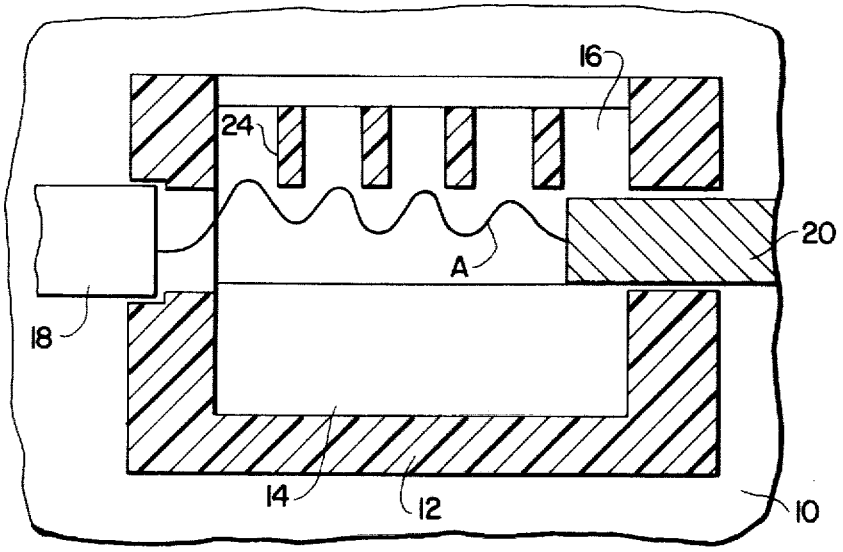
FIG. 6 is a replica of FIG. 4 useful in explaining the operation of the arrangement shown in FIGS. 4 and 5 with an electric arc illustrated as being established across the contact members shown in FIG. 4.

More specifically, when the low temperature, high pressure fluid within the pressure increasing compartment 14 is delivered to the housing 10 as above described in conjunction with FIG. 1, the arc splitters 24 limit the movement of the electric arc as shown by an electric arc A in FIG. 6. As a result, thermal energy resulting from the electric arc is effectively utilized to accumulate a fluid pressure within the pressure increasing compartment 14. On the other hand, the low temperature, high pressure fluid released through the now open opening 16 flows and diffuses to cross the electric arc perpendicularly to the longitudinal axis thereof as above described in conjunction with FIG. 1, while the arc splitters 24 are effective for blowing the low temperature, high pressure fluid against the arc space at several portions, thus resulting in a more rapid extinction of the electric arc.

Figure 7:
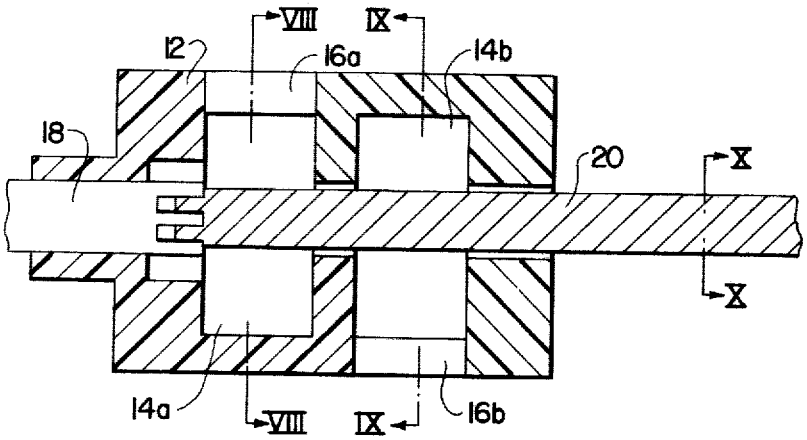
FIG. 7 is a fragmental longitudinal sectional view of another modification of the present invention.
Figure 8:
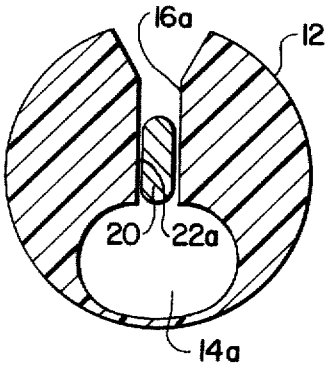
FIG. 8 is a cross sectional view as taken along the line VIII—VIII of FIG. 7.
Figure 9:
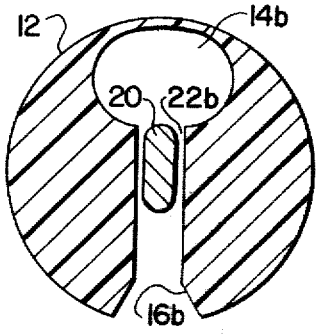
FIG. 9 is a cross sectional view as taken along the line IX—IX of FIG. 7.

The arrangement illustrated in FIGS. 7, 8 and 9 is different from that shown in FIGS. 1, 2 and 3 principally in that in FIGS. 7, 8, 9 and 10 the envelope 12 of circular cross section defines therein a pair of pressure increasing compartments 14*a* and 14*b* disposed in tandem manner and including respective openings 16*a* and 16*b* directed diametrically opposite to each other. More specifically the envelope 12 of circular cross section includes a pair of similar pressure increasing compartments 14*a* and14*b* disposed in tandem manner in the diametrically opposite portions thereof. In the example illustrated a pair of openings 16*a* and 16*b* similar to the opening 16 shown in FIG. 5 extend in parallel relationship through the envelope 12 to cross perpendicularly the longitidunal axis of the envelope 12 until the openings 16*a* and 16*b* open in diametrically opposite relationship on the surface of the envelope 12. Thus the pressure increasing compartments 14*a* and 14*b* are connected in fluid communication with the exterior of the envelope 12, that is to the housing 10 not shown in FIG. 7.

Figure 10:
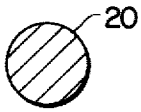
FIG. 10 is a cross sectional view as taken along the line X—X of FIG. 7.

The movable contact member 20 normaly extends through the openings 16*a* and 16*b* to close substantially the latter with small clearances 22*a* and 22*b* formed between the same and the opposite surfaces of the openings 16*a* and 16*b* respectively. To this end, the cross section of the movable contact member is in the form of a prolate circle as shown in FIGS. 8 and 9 for that portion thereof entered into the envelope 12 at its closed position and in the form of a circle as shown in FIG. 10 for that portion thereof located externally of the envelope 12 at its closed position, as will readily be understood from the illustration of FIG. 7.

In other respects, the arrangment is identical to that shown in FIGS. 1, 2 and 3.

At the beginning of the opening operation, an electric arc is struck across the stationary and movable contact members 18 and 20 respectively and established in the narrow clearances 22*a* or 22*b* to block the arc extinguishing fluid disposed in the pressure increasing compartments 14*a* or 14*b* respectively. Therefore the pressure increasing compartments 14*a* or 14*b* rapidly increase in pressure.

Figure 11:
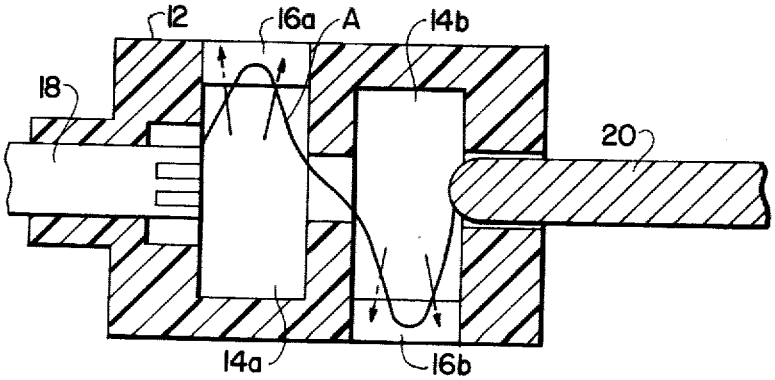
FIG. 11 is a replica of FIG. 7 useful in explaining the operation of the arrangement shown in FIGS. 7, 8, 9 and 10 with an electric arc illustrated as being established across the contact members shown in FIG. 7.

Then, as in the arrangement shown in FIGS. 1, 2 and 3, the pressure increasing compartments are released from being blocked to cause the low temperature, high temperature fluid within both compartments to be delivered externally of the envelope 12 through the openings 16*a* and 16*b* and in opposite directions. At that time, the delivered fluid perpendicularly crosses the electric arc as shown at curve A in FIG. 11 while the fluid from the pressure increasing compartment 14*a* flows and diffuses in a direction opposite to a direction in which the fluid from the compartment 14*b* does. In addition, that portion of the electric arc located adjacent to the stationary contact member 18 is subjected to a force in a direction reverse from a direction in which a force is applied to that portion of the arc located adjacent to the movable contact member 20, as shown by the arrows in FIG. 11. As a result, the tendency of the electric arc A to be moved away from the blowing fluid is limited to the vicinity of the openings 16*a* and 16*b*. This permits thermal energy to be sufficiently accumulated in the pressure increasing compartments 14*a* and 14*b* and the high pressure fluid is continuously blown against the electric arc, thus resulting in the rapid extinction of the electric arc.

While the present invention illustrated in FIGS. 7, 8, 9 and 10 has been described in conjunction with the envelope including a pair of pressure increasing compartments disposed in tandem manner, it is to be understood that it is equally applicable to an envelope including more than two pressure increasing compartments. In the latter case, alternating ones of tandem disposed compartments may open on the surface of the envelope in a direction diametrically opposite to the direction in which the remaining compartments do. Further it is to be understood that the difference in direction in which each pair of adjacent compartments open on the surface of the envelope is not restricted to an angular interval of 180 degrees as shown in FIGS. 8 and 9 and that the angular interval may be of any desired angle other than 180 degrees.

The arrangement illustrated in FIGS. 12, 13, 14, 15 and 16 comprises a plurality of pressure increasing compartments, in this case, three compartments having different volumes and disposed in tandem manner but in independent relationship for the purpose of effecting always the extinction of electric arcs in a stabilized manner regardless of the magnitudes of current to be interrupted.

The arrangement illustrated comprises an envelope generally designated by the reference numeral 12 including a hollow cylindrical base member 26 of round rectangular cross section including one end, in this case, the lefthand end as viewed in FIG. 12 closed with an apertured end plate 28. Like the envelope 12 as above described, the base member 26 is formed of a heat resisting, electrically insulating material, for example, polytetrafluoroethylene and the end plate 28 is formed of any suitable electrically conductive material. The end plate 28 includes a central small aperture 30 of suitable shape and a supporting electrically conductive member 32 from the periphery extending into the interior of the base member 26.

The stationary contact member 18 is shown in FIG. 12 as being in the form of two U-shaped contact arms disposed oppositely to each other so that those opposite legs of both U-shaped arms located adjacent to the end plate 28 are suitably fixed on the supporting member 32 and the remaining opposite legs thereof define therebetween a gap through which the movable contact member 20 can just extend to be separably engaged by the stationary contact member 18. In the example illustrated, the movable contact member 20 is in the form of a prolate circle as will be described hereinafter.

Then an arc contact member 34 of any suitable electrically conductive material extends into the interior of the base member 26 from the inner surface of the end plate 28 to encircle the stationary contact member 18 with a predetermined spacing maintained therebetween. The arc contact member 34 is provided at the free end with a flange directed toward the longitudinal axis of the envelope 12 to overhang that end of the stationary contact member 18 remote from the end plate 28 and to define an opening located on the longitudinal axis of the envelope 12 and spaced from the end of the stationary contact member 18 by a predetermined axial distance. The opening on the arc contact member 34 is dimensioned so that the movable contact member 20 can movably extend through and contact it.

As shown in FIG. 12, the envelope 12 includes a first, a second and a third pressure increasing compartments 36, 38 and 40 respectively disposed in tandem manner and in the named order. In order to isolate physically each pair of adjacent compartments, a compartment forming member 42 is interposed therebetween. Also another compartment forming member 42 closes that end of the compartment 40 farthest remote from the end plate 28, that is to say, the other end of the envelope 12.

As shown in FIG. 13, the compartment forming member 42 is in the form of a plate identical in outer profile to the base member 26 while it includes a central hole 50 in the form of a circle prolate along the vertical central axis as viewed in FIG. 13 and four circular holes 42*a*, 42*b*, 42*c* and 42*d* located at corners thereof for a purpose as will be apparent hereinafter.

FIGS. 14, 15 and 16 show other compartment forming members 44, 46 and 48 respectively in the form of plates identical in overall shape to the compartment forming member 42.

The compartment forming member 44 illustrated in FIG. 14 is different from that shown in FIG. 13 only in that in FIG. 14 a U-shaped opening 52 extends through the lower portion thereof as viewed in FIG. 14 and includes a pair of legs of the "U" extending into the upper portion thereof to surround the central hole 54 identical to the central hole 50 as shown in FIG. 13.

The compartment forming member 46 illustrated in FIG. 15 includes a double U-shaped opening 56 centrally extending therethrough. When the compartment forming members 44 and 46 superpose each other, the U-shaped opening 52 on the forming member 44 has the opposite vertical edges as viewed in FIG. 14 aligned with those of the opening 56 on the forming member 46 and the lower edge as viewed in FIG. 14 aligned with the free ends of legs of the lower "U" as viewed in FIG. 15 of the opening 56. However, the free ends of legs of the upper "U" as viewed in FIG. 15 somewhat extend beyond those of the U-shaped opening 52 while the central vertical portion as viewed in FIG. 15 of the opening 56 covers the central hole 54 and has a vertical length substantially equal to the major length of the central hole 54.

The compartment forming member 48 illustrated in FIG. 16 is different from that shown in FIG. 14 only in that in FIG. 16 an U-shaped opening 58 similar to the U-shaped opening 52 communicates with a slit 60 substituted for the central hole 54 on the compartment forming member 44 and opening in a vertex of a V-shaped notch 62 disposed on the upper portion as viewed in FIG. 16 of the compartment forming member 48.

All the compartment forming members 42, 44, 46 and 48 include circular holes disposed at four corners thereof so as to be aligned with the circular holes 42*a*, 42*b*, 42*c* and 42*d* on the member 42 when all the members 42, 44, 46 and 48 superpose one another. Each of those circular holes as designated by the same reference numeral identifying the mating compartment forming member and suffixed with the reference character a, b, c or d. For example, the circular hole disposed at the upper and lefthand corner as viewed in FIG. 15 of the member 46 is designated by the reference numeral and character 46*a*.

All the compartment forming members are composed of the same material as the base member 26. In FIG. 12, the compartment forming members 42 and 44 are shown as being equal in thickness to each other and thinner than the members 46 and 48 which are shown as being equal in thickness to each other.

As shown in FIG. 12, two members 44, two members 48 and a member 42 are successively superposed in the named order, on the other end of the base member 26 to form the first pressure increasing compartment 36 with the base member 26, the end plate 28 and the arc contact member 34. This compartment 36 includes a first space 14A formed within the base member 26 and a second space 14B formed of the aligned U-shaped openings 58 in the two members 48 to be connected at one end to the first space 14A through the aligned U-shaped openings 52 in the two members 44 and closed at the other end with the member 42.

Then two members 46, a member 44, and two members 48 are successively superposed, in the named order, on the member 42 closing the first compartment 36 to form the second pressure increasing compartment 38. The second compartment 38 includes a first space 14A formed of the aligned double U-shaped openings 56 in the two members 46 and a second space 14B formed of the aligned U-shaped openings 58 in the members 48 to be connected to the first space 14A through the U-shaped opening 52 in the member 44 and closed with another member 42.

Subsequently, the third pressure increasing compartment 40 is formed between the last-mentioned member 42 and a different member 42 by interposing therebetween a stack of a member 46, a member 44 and two members 48 superposed on one another in the named order. The third compartment 40 similarly includes a first space 14A formed of the double U-shaped opening 56 in the member 46 and a second space 14B formed in the same manner as that of the second compartment 38 to be similarly connected to the first space 14A and closed with the rightmost member 42 as viewed in FIG. 12.

Following this, a long bolt (not shown) is threaded into the aligned holes located at each of the corners of the compartment forming members disposed in superposed relationship and screw threaded into a threaded hole (not shown) disposed at the other end of the base member 26 to be aligned with those aligned holes. Therefore the envelope 12 is formed into a unitary structure.

In each of the pressure increasing compartments 36, 38 or 40, the slit 60 and the V-shaped notch 62 form an opening 16 through which the associated second space 14B opens into a housing (not shown) in which the envelope 12 is disposed as in the arrangement of FIG. 1.

From the foregoing it is seen that the first compartment 36 is greater in volume than the second compartment 38, which in turn has a volume greater than that of the third compartment 40 because the second compartment 38 includes a number of 7 members 46 greater than in the third compartment 40. In other words, the pressure increasing compartments successively reduce in volume as they become distant from the stationary contact member 18.

In the example illustrated the movable contact member 20 is complementary in shape to and slightly smaller than the central holes 50 and 54 on the members 42 and 44. The movable contact member 20 is extended through the central holes 50 and 54 in the members 42 and 44, the centers of the double U-shaped openings 56 in the members 46 and the openings 16 in the members 48 until the free end portion thereof slidably extends in contact relationship through the openings on the arc contact member 34 and the stationary contact member 18. Under these circumstances, the movable contact member 20 engages the stationary contact member 18 and substantially blocks the central hole 54 in each member 44 and the opening 16 of each of the second spaces 14B with narrow clearances formed therebetween. However, each of the second spaces 14B communicates with the mating first space 14A through the U-shaped opening 52 in the associated member 44 as above described.

As in the arrangement of FIG. 1, the movable contact member 20 is connected at the other end to an operating mechanism such as trip means although the mechanism is not illustrated. Also the pressure increasing compartments 36, 38 and 40 are filled with amounts of the arc extinguishing fluid.

Upon any excessive current flowing through the arrangement of FIG. 12 for any reason, the movable contact member 20 is moved in the righthand direction as viewed in FIG. 12 in the same manner as above described in conjunction with the arrangement shown in FIGS. 1, 2 and 3 until contact members 18 and 20 disengage from each other. At that time an electric arc is struck across the separated contact members 18 and 20, but one root of the electric arc immediately transfers from the stationary contact member 18 to the arc contact member 34 put at the same electric potential as the stationary contact member 18. Thereafter the electric arc is established across the arc and movable contact member 34 and 20. Under these circumstances heat generated by the electric arc causes the arc extinguishing fluid within the first pressure increasing compartment 37 to rise in pressure rapidly and in order to increase the pressure of the arc extinguishing fluid at a temperature as low as possible, the small aperture 30 has beein disposed in the end plate 28 and at a position close to a position where the electric arc is struck. If desired, the aperture 30 may be omitted.

The movable contact member 20 is further moved in the righthand direction until the free end thereof reaches the opening 16 of the second space 14B in the first pressure increasing compartment 36. At that time the opening 16 is occupied by the arcing fluid at an elevated temperature provided that the resulting arc current is close to the peak value thereof. Therefore the opening 16 is blocked with the arcing fluid at the elevated temperature.

Then as soon as the process of decreasing the arc current is begun, the electric arc reduces in transverse dimension until an annular gap is caused around the electric arc within the opening 16. This permits the arc extinguishing fluid at a low temperature within the first pressure increasing compartment 36 to be delivered to the exterior of the compartment 36 through the now formed gap and at a flow speed as determined by a pressure difference between the interior and exterior of the first compartment 36. The delivered fluid flows through the opening 16 in a direction in which the cross sectional profile of the movable contact member 20 is elongated, and perpendicularly to the axis of the electric arc.

The delivered fluid causes the arcing high temperature fluid to be mixed with the same and also with an arc extinguishing fluid that is located externally of the pressure increasing compartment 36 or within a housing (not shown) such as the housing 10 shown in FIG. 1. The mixed fluid cools the arcing high temperature fluid to reduce an arc space occupied by the latter until the opening 16 is fully released, resulting in the extinction of the electric arc.

From the foregoing it is seen that the first space 14A receives heat resulting from the electric arc to perform principally the function of increasing the pressure of the arc extinguishing fluid while the second space 14B is operated to deliver the high pressure fluid through the opening 16 to the exterior thereof resulting in the extinction of the electric arc. Therefore, the pressure increasing compartment 36 forms an arc extinguishing compartment with the opening 16.

In the process of extinguishing the electric arc as above described, the arc extinguishing fluid flows along arrowed solid curve depicted within the first compartment 36 in FIG. 12 and also in FIGS. 15 and 16. FIG. 12 further illustrates a direction of flow of the arc extinguishing fluid within each of the second and third compartment 38 or 40 respectively at associated solid curves with arrows.

Now assuming that the particular arc current is of a moderate magnitude, the first pressure increasing compartment 36 has its volume greater than required requied for interrupting that arc current. Under the assumed conditions the arc extinguishing fluid within the first compartment 36 does not sufficiently increase in pressure. Accordingly, after the movable contact member has left the opening 16 of the second space 14B in the first compartment 36, the electric arc remains established in the first compartment 36. That is, the electric arc is not extinguished in the first compartment 36.

On the other hand, the second pressure increasing compartment 38 has a volume smaller than that of the first compartment 36 by enough to increase the pressure of the arc extinguishing fluid therein with an arc current having a moderate magnitude such as above described. The electric arc remaining established in the first compartment 36 enters the first space 14A of the second compartment 38 to increase the pressure of the fluid therein after which it is extinguished within the second compartment 38 in the same manner as above described in conjunction with the first compartment 36.

If the arc current is lowered to a magnitude that is somewhat higher than the rated load current, then the resulting electric arc is similarly extinguished within the third pressure increasing compartment 40 which has a volume smaller than that of the second compartment 38.

From the foregoing it is seen that the first, second and third pressure increasing compartments 36, 38 and 40 respectively are operative to extinguish electric arcs resulting from high, moderate and low currents respectively.

The present invention is advantageous in that the current carrying capacity and interrupting performance thereof can be independently controlled. This is because the current carrying capacity can be increased by increasing the major dimension of the cross sectional profile of the movable contact member 20 (see for example a, FIG. 2) or the dimension of the opening 16 measured perpendicularly to the longitudinal axis of the contact member 20. On the other hand, by selecting properly the width of the opening 16 (see, for example, l, FIG. 12) and therefore the minor dimension of the cross sectional profile of the contact member 20 (see, for example b, FIG. 2), it is possible to adjust both the flow speed at which the arc extinguishing fluid at low temperatures blows against an electric arc perpendicularly thereto and the time interval for which the fluid is sustained to blow against the electric arc. This measure can cope with different current carrying capacities. Since one can select the major and minor dimensions of the cross sectional profile of the movable contact member 20 or the corresponding dimensions of the opening 16 in quite independent manner, the current carrying capacity can be determined quite independently of the interrupting performance. Further the embodiment of the present invention shown in FIG. 12 is advantageous in that it can be very easily manufactured by superposing selectively a desired number of the compartment forming members 42, 44, 46 and 48 to form a desired number of pressure increasing compartments in tandem manner after which those compartments are connected together into a unitary structure by means of simple fastening means. Also each of the pressure increasing compartments can readily change in volume only by varying the number of the compartment forming members 44, 46 and 48. This is particularly effective for manufacturing a plurality of pressure increasing compartments having sufficient volumes and disposed in tandem manner.

While the present invention has been illustrated and described in conjunction with a few preferred embodiments thereof it is to be understood that numerous changes and modifications may be resorted to without departing from the spirit and scope of the present invention. For example, the arrangement shown in FIGS. 12, 13, 14, 15 and 16 may include pressure increasing compartments whose number is greater than three while the volumes thereof are successively reduced as the compartments become distant from the stationary contact member. Also it may be modified to include a plurality of pressure increasing compartments having the same volume. In the latter case, it is possible to extinguish an electric arc with a high arc current in that pressure increasing compartment located nearest to the stationary contact member while extinguishing an electric arc with a low arc current in the plurality of compartments in such a manner that those compartments cooperate with one another to cause amounts of the arc extinguishing fluid filling the respect compartments to act on the electric arc at associated positions. Further, alternating ones of the pressure increasing compartments may include their openings 16 having a common direction forming an angle of 90 or 180 degrees with that of openings communicating with the remaining compartments. In addition, the dimensions of the openings 16 measured along the longitudinal axis of the envelope 12 may be different from one another in accordance with the volumes of the associated pressure increasing members.

What we claim is:

1. An arc self-extinguishing switch device comprising:

a housing having an interior filled with an arc extinguishing fluid;

an envelope disposed within said interior of said housing, said envelope having therein at least one pressure increasing compartment filled with said arc extinguishing fluid;

first contact member means positioned within said compartment;

second contact member means, movable from a closed first position in contact with said first contact member means toward an open second position spaced from said first contact member means, for, upon movement of said second contact member means away from said first contact member means, establishing an electric arc between said first and second contact member means, whereby said electric arc increases the pressure of said arc extinguishing fluid in said compartment;

said envelope having extending through a side thereof, from said compartment to said interior of said housing, opening means for discharging said increased pressure arc extinguishing fluid from said compartment to said interior of said housing in a direction substantially transverse to and crossing the axis of said electric arc;

said opening means comprising a straight slit having a depth in said direction and a width transverse to said direction and to said axis of said electric arc, said depth being substantially greater than said width, such that said slit is elongated in said direction; and said second contact member means, when in said closed first position thereof, extending through said slit and closing said slit, said second contact member means having a flat cross-section elongated in said direction, and said movement of said second contact member means away from said first contact member means opening said slit.

2. An arc self-extinguishing switch device as claimed in claim 1, wherein said first contact member means is stationary, and said second contact member means has a cross-section in the form of a rectangle or an ellipse.

3. An arc self-extinguishing switch device as claimed in claim 1, wherein said slit extends along said axis of said electric arc.

4. An arc self-extinguishing switch device as claimed in claim 1, wherein said envelope includes a plurality of arc splitter means for dividing said slit in a direction axially of said electric arc into a plurality of opening portions.

5. An arc self-extinguishing switch device as claimed in claim 4, wherein said arc splitter means are composed of an electrically insulating material.

6. An arc self-extinguishing switch device as claimed in claim 1, wherein said envelope has therein a plurality of pressure increasing compartments aligned in tandem manner and in a direction in which said second contact member means disengages from said first contact member means.

7. An arc self-extinguishing switch device as claimed in claim 6, wherein each pair of adjacent said pressure increasing compartments have extending therefrom respective said slits formed so that one said adjacent pressure increasing compartment delivers said arc extinguishing fluid in a direction different from that of delivery of said arc extinguishing fluid from the other said adjacent pressure increasing compartment.

8. An arc self-extinguishing switch device as claimed in claim 6, wherein said plurality of pressure increasing compartments have different volumes.

9. An arc self-extinguishing switch device as claimed in claim 8, wherein each said compartment has extending therefrom a respective said slit, and the dimensions of said slits measured along the longitudinal axis of said envelope are different from one another in accordance with said volumes of the respective said pressure increasing compartments.

10. An arc self-extinguishing switch device as claimed in claim 1, wherein said pressure increasing compartment includes a first space receiving heat resulting from said electric arc and a second space disposed in a direction in which said second contact member means is separated from said first contact member means, said first space being connected in fluid communication to said first space, and said second space communicating with said slit.

11. An arc self-extinguishing switch device as claimed in claim 1, wherein said envelope includes one end portion having said first contact member means fixed therein, and a remaining portion integrally connected to said one portion and formed of a plurality of compartment forming members in the form of plates superposed on one another in a direction in which said second contact member means is separated from said first contact member means, said plates forming a plurality of said pressure increasing compartments each including a respective said slit.

12. An arc self-extinguishing switch device as claimed in claim 1, wherein said arc extinguishing fluid comprises gaseous sulfur hexafluoride ($SF_6$).

13. An arc self-extinguishing switch device as claimed in claim 1, wherein said envelope is composed of polytetrafluoroethylene.

* * * * *